United States Patent [19]

Farmer

[11] 4,411,085

[45] Oct. 25, 1983

[54] SLIT-TUBE SIGN STAND

[75] Inventor: Ian W. Farmer, Waltham Cross, England

[73] Assignee: Arken, Inc., Bloomfield Hills, Mich.

[21] Appl. No.: 337,720

[22] Filed: Jan. 7, 1982

[30] Foreign Application Priority Data

Feb. 13, 1981 [GB] United Kingdom ..... 81998893

[51] Int. Cl.[3] ..... G09F 15/00; G09F 7/22

[52] U.S. Cl. ..... 40/610; 40/612; 40/617

[58] Field of Search ..... 40/617, 612, 610, 606

[56] References Cited

U.S. PATENT DOCUMENTS

| | | | |
|---|---|---|---|
| 2,995,847 | 8/1961 | Carpenter | 40/125 |
| 3,165,847 | 1/1965 | Gunderson | 40/610 |
| 3,408,700 | 11/1968 | Chase | 40/23 R |
| 3,494,057 | 2/1970 | Ford | 40/10 R |

FOREIGN PATENT DOCUMENTS

| | | | |
|---|---|---|---|
| 506467 | 5/1939 | United Kingdom | 40/10 R |
| 614894 | 12/1948 | United Kingdom | 40/10 R |
| 627849 | 8/1949 | United Kingdom | 40/10 R |
| 858835 | 1/1961 | United Kingdom | 40/10 R |
| 1143991 | 2/1969 | United Kingdom | 40/10 R |
| 1160484 | 6/1969 | United Kingdom | 40/10 R |
| 1311582 | 3/1973 | United Kingdom | 40/10 R |
| 1543559 | 4/1979 | United Kingdom | 40/10 R |

*Primary Examiner*—Gene Mancene
*Assistant Examiner*—James Hakomaki
*Attorney, Agent, or Firm*—Harness, Dickey & Pierce

[57] ABSTRACT

A transportable, foldable, compact sign stand device is disclosed which includes a frame section in which a center panel for receiving advertising messages and the like is suspended or attached. A single tubular member is bent to form the device and it comprises two parallel leg members and an upstanding frame section. The center panel is attached to the upper cross-bar or the two side members of the frame section. A slot is provided under the upper cross-bar of the frame section to relieve tension and allow the leg members to be moved easily to their open and closed positions. A foldable bracket is attached to the leg members to hold them in their open positions.

7 Claims, 6 Drawing Figures

FIG. 1.
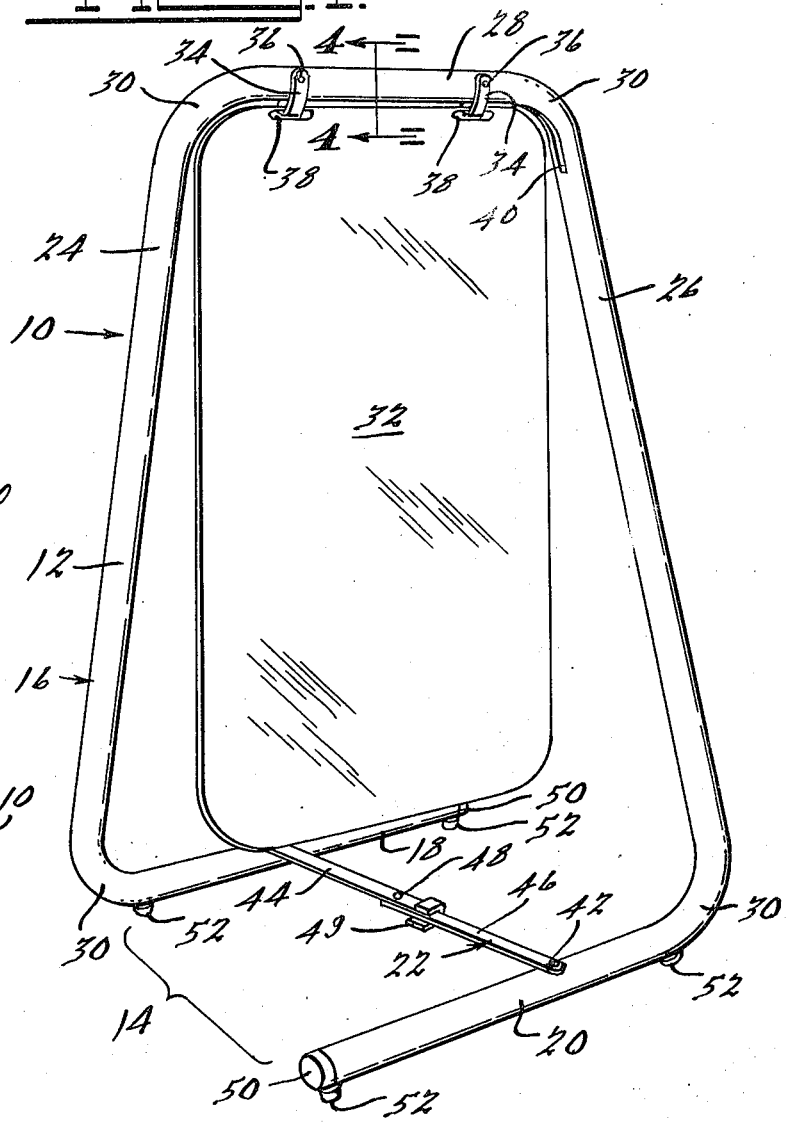
FIG. 2.
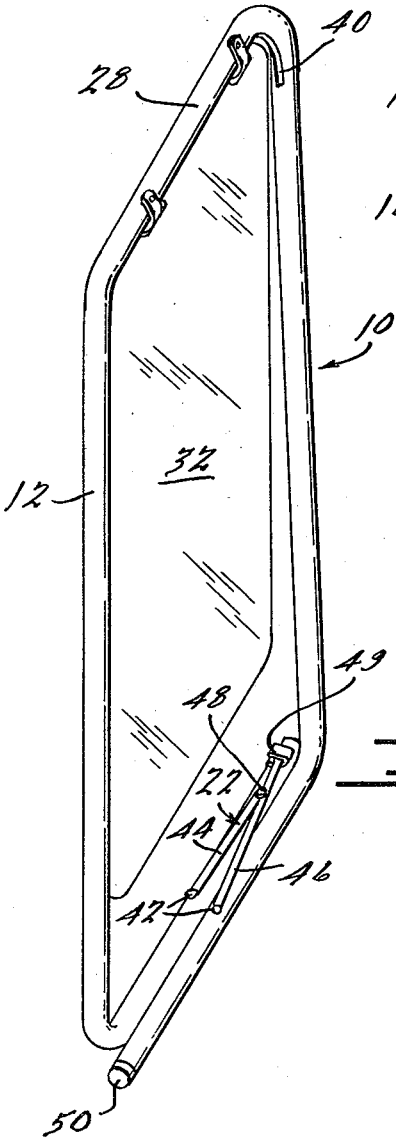
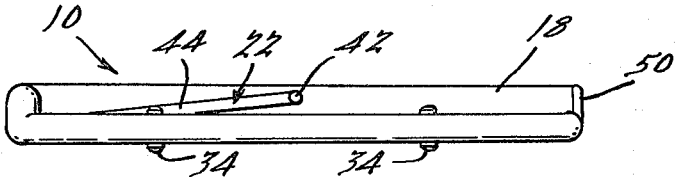
FIG. 3.

SLIT-TUBE SIGN STAND

BACKGROUND—SUMMARY OF THE INVENTION

The present invention relates to sign stands and poster display devices. There are numerous types and sizes of sign stands and poster display devices which are in use today for displaying advertising and informative messages to the public as they pass by. Known devices range from single panels which are permanently attached to walls or posts to much larger multipaneled devices which are often heavy and difficult to store and move.

The present invention provides a sign stand device which has a minimum of parts (and thus will not wear out or break down prematurely), accommodates easy handling and storage (collapses into a compact and ready transportable package), and has a lightweight, sturdy, and aesthetic construction. Sign stands which meet these objects are in much demand today.

The inventive sign stand is comprised of a single piece of tubular material which is bent or formed into a structure having an upstanding frame section and elongated leg or base members. A two-faced panel for advertising messages and the like is suspended from or attached to the frame section and presented for display inside the frame section. An elongated slit is provided along the underside of the top frame member (upper cross-bar) and preferably extends through the bent corners on each end of the cross-bar. The slit relieves the torsional forces in the single-piece bent frame section which would prevent it from being easily opened and closed. The slit also prevents the sign stand device from being permanently distorted when it is manipulated to its open and closed positions. When the sign stand is "opened" for display purposed, the two legs are spread apart in a substantially parallel manner and provide a stable base. A foldable bracket attached to the two leg members is used to retain the legs in the "open" position.

When the sign stand is not being displayed, it folds into a narrow, compact unit for storage. In this position, the two legs are moved to positions adjacent to, touching, or on top of each other.

Other objects, features, benefits and advantages of the invention will become apparent when the following description of the sign stand is reviewed in combination with the accompanying drawings.

BRIEF DESCRIPTION OF THE DRAWINGS

FIG. 1 is a perspective view of a sign stand in an open position in accordance with one embodiment of the present invention;

FIG. 2 is a perspective view of the sign stand device in FIG. 1 illustrating it from an end and side in its closed position;

FIG. 3 is a top plan view of the sign stand of FIGS. 1 and 2;

DESCRIPTION OF THE PREFERRED EMBODIMENTS

Figure 4:
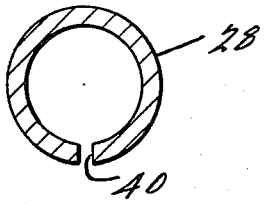
FIG. 4 is a cross-sectional view of the upper cross-bar of the sign stand of FIGS. 1–3, taken along the lines 4—4 of FIG. 2.

Referring to the embodiment of the invention illustrated in FIGS. 1–4, it will be noted that the sign stand or poster display device 10 is comprised of a single piece of tubing 12 which preferably is hollow and formed in the shape shown. The single piece of tubing 12 is preferably made of a metal material, such as steel or aluminum, but also can be made of a sturdy plastic material, such as polystyrene. The exterior surface of the tubing 12 preferably has a coating or baked-on finish which is weather-resistant and attractive looking. The tubing 12 can be bent or shaped into the form shown by any conventional method known for forming metal tubing or bending plastic tubing.

The tubing 12 is formed into a structure having a base section 14 and an upstanding frame section 16. The base section 14 has two leg members 18 and 20 which are connected together with a foldable bracket 22. The frame section 16 is generally rectangular in shape with two side members 24 and 26 and a top member (or upper cross-bar) 28. As can be seen from the drawings, all of the members 18, 20, 24, 26 and 28 are made from a single piece of material and connected by four rounded or bent-formed corners 30.

A sign panel 32 is suspended in the center of the rectangular frame 16 in the preferred embodiment shown in FIGS. 1–3. The panel 32 has two planar surfaces for display and presentation of advertising messages and the like. The panel 32 is preferably made of thin sheet metal, such as aluminum, but can be made of any material which is thin, lightweight, sturdy and capable of having posters or other messages attached or imprinted thereon.

The panel 32 is suspended from the upper cross-bar 28 of the frame section by a pair of hinges 34. The hinges are attached by fasteners 36 to the cross-bar and extend through openings 38 in the panel. When the panel 32 is suspended freely from the frame 16, it hangs down substantially perpendicular to the ground so that it can display its two advertising surfaces in an optimum manner to passers-by.

It is understood that the present invention is not limited to a specific manner in which the sign panel 32 is attached to or suspended from the frame section 16. Another manner is shown, for example, in FIGS. 5 and 6. There further are numerous other ways known in the art and any of these other methods can be utilized.

A slot 40 is provided along the underside of the upper cross-bar 28 of the frame section 16. (FIG. 4 is a cross-sectional view of the cross-bar 28 showing the slot 40.) Preferably the slot 40 extends along the entire length of the cross-bar and down through the inside of the corners 30 on each end of the cross-bar. The slot relieves the torsional forces which are present in the single-piece of tubing 12 when it is formed in the shape shown and allows the sign stand to be manipulated to its opened and closed positions easily and without any permanent deformation of the tubing.

The slot 40 is formed or cut into the tubing 12 by any conventional means and can be made either before or after the tubing 12 is formed into the sign stand shape.

The two leg members 18 and 20 are substantially parallel to each other. When the sign stand is in its "closed" position, as shown in FIGS. 2 and 3, the leg members 18 and 20 are positioned side-by-side allowing the folded sign stand to assume a thin, compact package for transportation and storage. When the sign stand is in its "open" position ready for display (as shown in FIG. 1), the leg members 18 and 20 are spread apart forming a stable base 14.

The foldable bracket 22 is attached to the leg members by a pair of fasteners 42. The bracket 22 is of conventional design with a pair of foldable arms 44 and 46 connected by a pivot mechanism 48. When the sign stand is closed for storage, the bracket 22 assumes its folded position and lies out of the way along the top of the two leg members 18 and 22 (see FIGS. 2 and 3). When the sign stand is opened for viewing, the bracket locks into the straight position helping to hold the two leg members apart (see FIG. 1). For this purpose, lock mechanism 49 is attached to the free end of arm 44. The bracket 22 also limits the distance that the leg members can be spread apart and this prevents the legs of the sign stand from being inadvertently and unnecessarily pulled too far apart.

The ends of the two leg members 18 and 20 are sealed with caps or plugs 50 to provide a "finished" look and also to keep dirt, water and other debris from entering the tubing. Small plastic or rubber base mounts or "feet" 52 are provided on the bottoms of the leg members 18 and 20. These mounts 52 protect the bottom of the leg members from being scratched or damaged and also help prevent the sign stand from sliding along the ground when high wind forces are present. For increased stability of the sign stand during windy conditions, it is also possible to put ballast or weights (not shown) in the inside of the two leg members 18 and 20.

Figure 5:
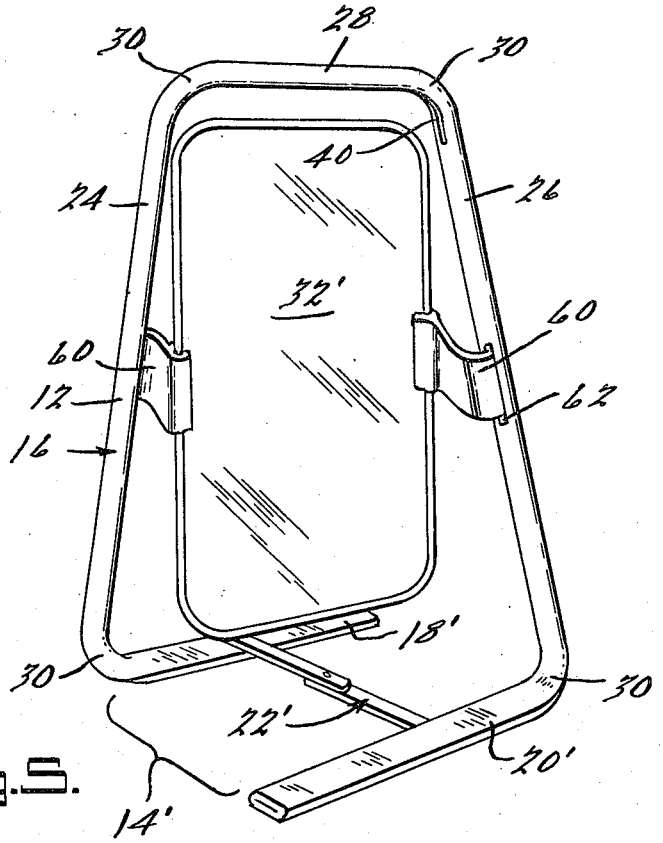
FIGS. 5 and 6 illustrate another embodiment of the invention in which the leg members are designed to overlap when the sign stand is folded into its storage position.
Figure 6:
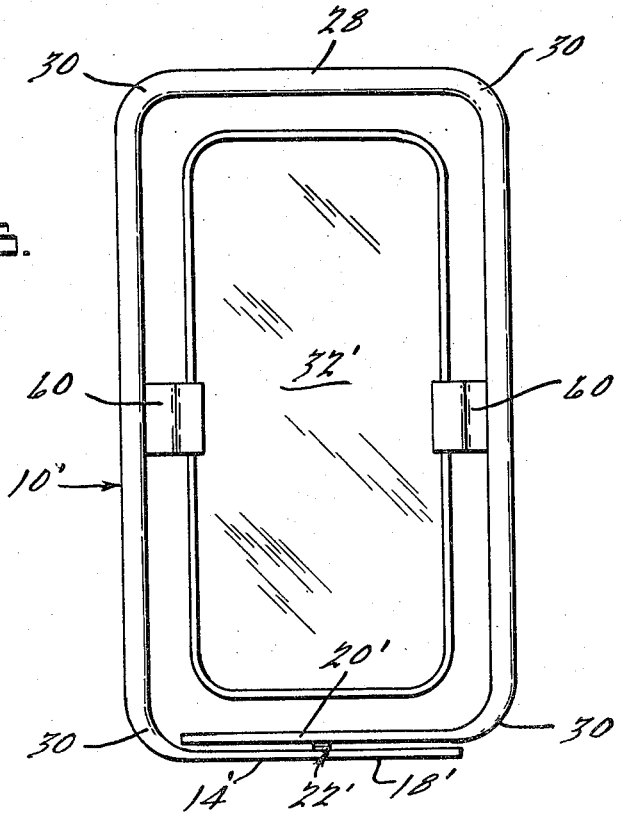

Another embodiment 10' of the invention is shown in FIGS. 5 and 6. Except for the base structure 14' and the manner in which the sign panel 32' is attached to the frame, this embodiment is the same as the sign stand described above with respect to FIGS. 1–4 and similar parts and features are marked by the same reference numbers. The device 10' has particular application as a warning road sign for use with construction projects.

In the sign stand 10', a single piece of tubing is bent or formed into the structure shown and a slot 40 is provided in the upper cross-bar 28. The two leg members 18' and 20' are adapted to be overlapped, i.e., positioned one on top of the other, when the sign stand is closed for storage and transportation. For this purpose, the leg members are flattened substantially along their entire lengths (at least for the extent that they overlap). With this embodiment, end caps or plugs are optional, "feet" or mounts are not included, and the foldable bracket 22' is connected to the top of one leg member (12') and the bottom of the other (20') so that it is positioned between the leg members when they are folded together for storage. It is also understood that the leg members do not have to be flattened, but can have the same cross-sectional shape as the leg members shown in FIGS. 1–3.

The sign panel 32' is also not suspended from the upper cross-bar of the sign stand 10' in the embodiment of FIGS. 5 and 6. Instead, flexible connecting members 60 are attached to the sides of the message panel 32' and are positioned in slots 62 formed in the side members 24 and 26 of the frame section 16. The connecting members 60 preferably are relatively loosely retained in the slots 62 so that they will not restrict in any manner the opening or closing of the sign stand.

The foregoing descriptions represent merely exemplary embodiments of the present invention. Various changes may be made in the arrangements and details of production of the embodiments shown without departing from the spirit and scope of the present invention.

I claim:

1. A sign stand for displaying advertising messages and the like comprising a single piece of tubular material formed into a base structure with two leg members and an upstanding frame structure, said frame structure having two upstanding side members and an upper cross-bar, said upper cross-bar having torsion-relieving means therein to allow said leg members to be spread apart easily and without permanently deforming any of said tubular material, said torsion-relieving means comprising a slot formed in said tubular material along the underside of said upper cross-bar, and a sign panel attached to and positioned in said frame structure.

2. The sign stand as set forth in claim 1 wherein said slot extends also into the upper portions of said two upstanding side members of said frame structure.

3. The sign stand as set forth in claim 1 further comprising means for holding said two leg members in said spread apart position.

4. The sign stand as set forth in claim 3 wherein said holding means comprises a foldable bracket.

5. The sign stand as set forth in claim 1 wherein said two leg members are adapted to overlap one another when the sign stand is folded up into its closed position.

6. The sign stand as set forth in claim 1 wherein said sign panel is attached to said two upstanding side members of said frame structure.

7. A sign stand for displaying advertising messages and the like comprising a single piece of tubular material formed into a base structure with two leg members and an upstanding frame structure, said frame structure having two upstanding side members and an upper cross-bar, said upper cross-bar having torsion-relieving means therein to allow said leg members to be spread apart easily and without permanently deforming any of said tubular material, said torsion-relieving means comprising a slot formed in said tubular material along the underside of said upper cross-bar, said slot extending into the upper portions of said two upstanding members of said frame structure, and a sign panel attached to and positioned in said frame structure.

* * * * *